US005766041A

United States Patent [19]

Morin et al.

[11] Patent Number: 5,766,041

[45] Date of Patent: Jun. 16, 1998

[54] SHIELD MEMBER FOR PANEL MOUNT CONNECTOR

[75] Inventors: Scott Frederick Morin, San Jose, Calif.; James Lee Fedder, Etters, Pa.; Aidymar Bigio, Campbell, Calif.; Michael Paul Derstine, Winston-Salem, N.C.; Jess Britton Ferrill, Madison, N.C.; Earl Watson Hancock, Winston-Salem, N.C.

[73] Assignee: The Whitaker Corporation, Wilmington, Del.

[21] Appl. No.: 656,108

[22] Filed: May 31, 1996

[51] Int. Cl.[6] ..... H01R 13/648

[52] U.S. Cl. ..... 439/609; 439/939

[58] Field of Search ..... 439/607, 609, 439/939, 79, 527, 544, 552, 567

[56] References Cited

U.S. PATENT DOCUMENTS

| | | | |
|---|---|---|---|
| 4,708,412 | 11/1987 | Himes, Jr. et al. | 439/95 |
| 4,738,638 | 4/1988 | Bogese, II | 439/610 |
| 4,842,554 | 6/1989 | Cosmos et al. | 439/609 |
| 4,906,210 | 3/1990 | Young et al. | 439/108 |
| 4,938,704 | 7/1990 | Fujiura | 439/95 |
| 5,030,140 | 7/1991 | Sugiyama | 439/607 |
| 5,067,914 | 11/1991 | Seidel et al. | 439/609 |
| 5,083,945 | 1/1992 | Miskin et al. | 439/607 |
| 5,112,251 | 5/1992 | Cesar | 439/607 |
| 5,207,597 | 5/1993 | Kline et al. | 439/607 |
| 5,267,882 | 12/1993 | Davis | 439/680 |
| 5,378,172 | 1/1995 | Roberts | 439/607 |
| 5,409,400 | 4/1995 | Davis | 439/610 |
| 5,429,520 | 7/1995 | Morlion et al. | 439/108 |
| 5,445,542 | 8/1995 | Serizay | 439/609 |
| 5,496,195 | 3/1996 | Reed | 439/607 |

FOREIGN PATENT DOCUMENTS

| | | | |
|---|---|---|---|
| 0 278 057 A1 | 8/1988 | European Pat. Off. | H01R 13/658 |
| 0 545 751 A1 | 6/1993 | European Pat. Off. | H01R 13/658 |
| 0 562 691 A1 | 9/1993 | European Pat. Off. | H01R 17/12 |
| 07 335334 A | 12/1995 | Japan | H01R 13/73 |

OTHER PUBLICATIONS

International Search Report mailed Aug. 27, 1997, in corresponding PCT Application; two pages.

U. S. Patent Application Serial No. 08/601,636 filed Feb. 14, 1996 (Abstract and Drawings only).

*Primary Examiner*—Khiem Nguyen

*Attorney, Agent, or Firm*—Anton P. Ness

[57] ABSTRACT

A shield for an electrical connector for being mounted in a panel cutout (62), wherein spring fingers (46,102,202,302) of the shield are engaged with surfaces defining the panel cutout (62) and are deflected thereby toward sides of the connector. Free ends (48,104,204,304) of the spring fingers are so formed that upon spring arm deflection the free ends enter into electrical engagement with other portions (54,108, 210,310) of the shield to enhance the shielding effectiveness.

6 Claims, 4 Drawing Sheets

SHIELD MEMBER FOR PANEL MOUNT CONNECTOR

FIELD OF THE INVENTION

This relates to the field of electrical connectors and more particularly to connectors having a shell member for EMI/RFI shielding.

BACKGROUND OF THE INVENTION

Electrical connectors are known that are mountable in a cutout of a panel as at an input/output port of an electronic apparatus such as a computer, or networking hubs, routers, or interfacing (NIC) cards. Such connectors preferably include a conductive shell therearound to protect the signal circuits thereof from electromagnetic and radiofrequency interference (EMI/RFI). The shell member is electrically connected to a ground circuit of the apparatus to dissipate the interference, such as including a contact section connected to a ground circuit of a circuit board to which the connector is mounted.

It is desired to provide enhanced shielding effect with a shell member surrounding the connector.

SUMMARY OF THE INVENTION

The present invention provides a shell member around the connector housing that includes an array of spring fingers extending laterally from the forward end of the shell to become engaged with the periphery of the panel cutout, where the fingers extend rearwardly along the side and top and bottom surfaces of the connector. The shield and/or free ends of the spring fingers are so adapted that the finger ends become engaged with a portion of the shield upon being deflected toward the connector upon insertion of the connector into the panel cutout. As a result, the spring fingers are electrically joined at both ends and do not act as antennae that generate an amount of interference.

Embodiments of the present invention will now be described by way of example with reference to the accompanying drawings.

DETAILED DESCRIPTION

Figure 1:
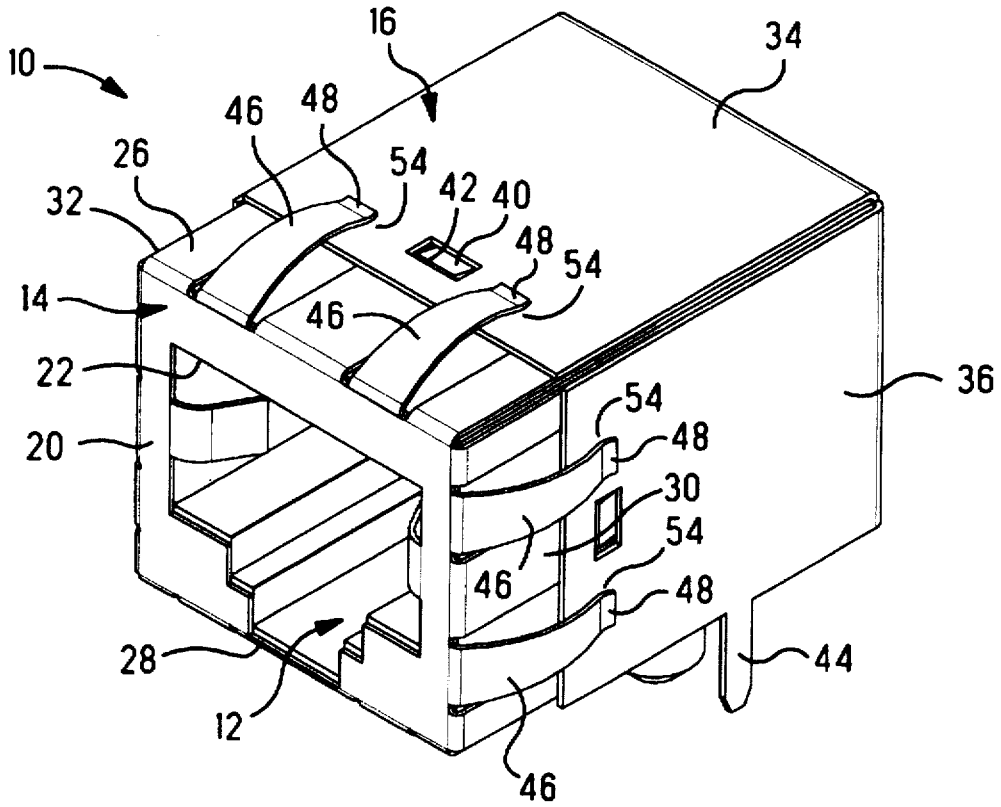
FIGS. 1 and 2 are isometric assembled and exploded views of a first embodiment of the invention utilizing two shell members assembled to the connector.
Figure 2:
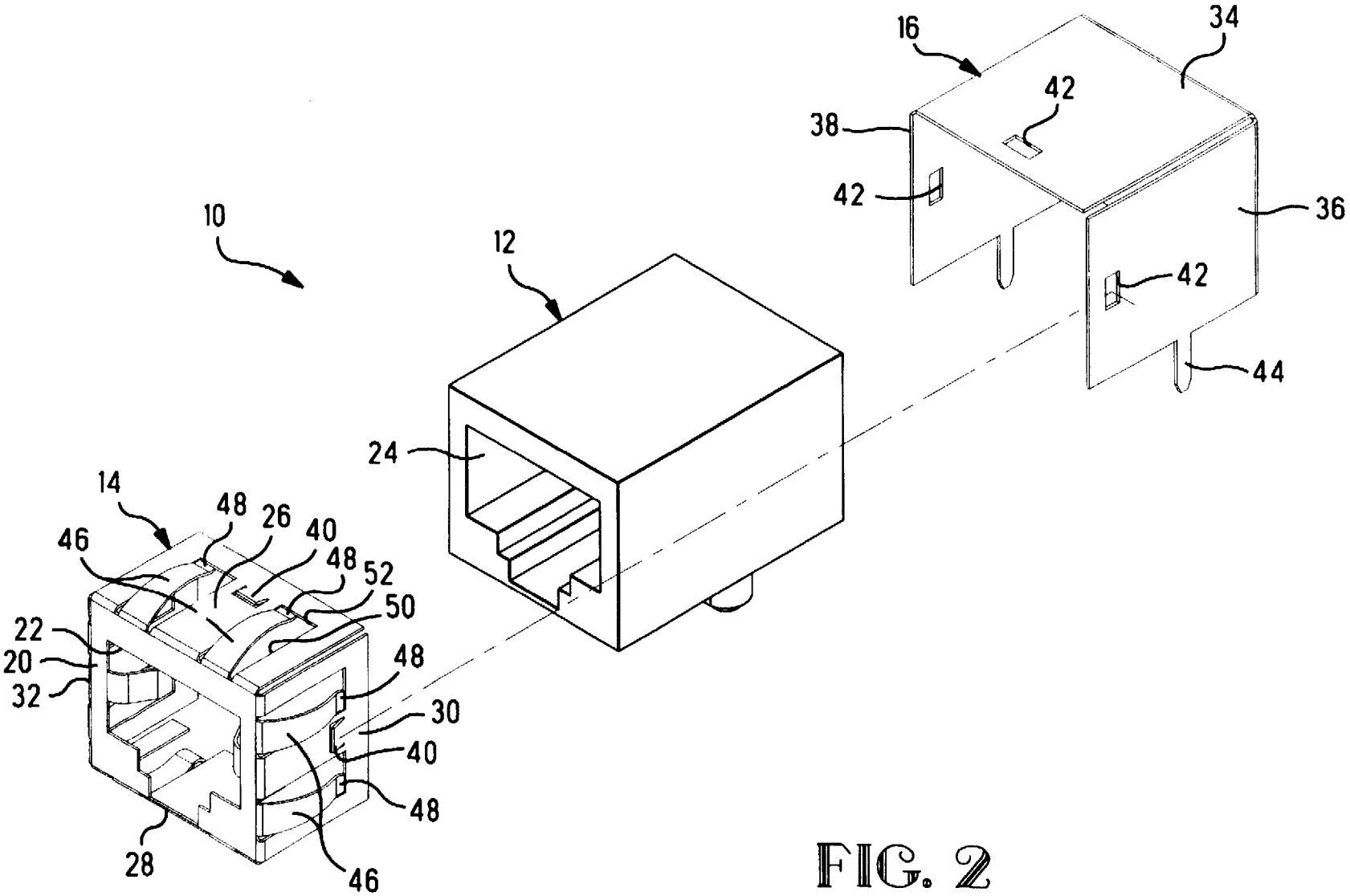

Connector 10 in FIGS. 1 and 2 includes an insulative housing 12 into which will be disposed an array of electrical contacts (not shown), and a front shell member 14 and a rear shell member 16 that will be assembled to housing 12 to define an EMI/RFI shield. Front shell member 14 is seen to have a front wall 20 having defined therein an opening 22 complementary to the plug-receiving opening 24 of housing 12, and upper wall 26, lower wall 28, and side walls 30,32 extending rearwardly from front wall 20. Rear shell member

16 includes an upper wall 34 and side walls 36,38. Locking lances 40 on walls 26,30,32 of front shell member 14 seat within recesses 42 of walls 34,36,38 of rear shell member 16 to secure the front and rear shell members together and also establish a ground continuity therebetween. Rear shell member 16 also is shown to include ground pins 44 depending from lower edges of side walls 36,38 for insertion into corresponding through holes of a circuit board (not shown) to which connector 10 is to be mounted, for electrical connection to ground circuits of the circuit board.

Arcuate spring fingers 46 extend rearwardly from peripheral edges of front wall 20 of front shell member 14 to free ends 48, and are formed convex outwardly such that free ends 48 are spaced outwardly from the planes of walls 26,28,30,32. It can be seen that front shell member 14 is easily stamped and formed from a blank of sheet metal such as brass or phosphor/bronze. When spring fingers 46 are stamped from the blank, cutouts 50 remain; and with forming the desired outward arcing of the spring fingers, the free ends thereof become clearly retracted from the trailing edges 52 of the cutout to which they previously had been integrally joined. However, upon assembly of front shell member 14 and rear shell member 16 to housing 12, it is seen that free ends 48 are now superposed above forward portions 54 of walls 34,36,38 of rear shell member 16, that at least partially cover cutouts 50.

Figure 3:
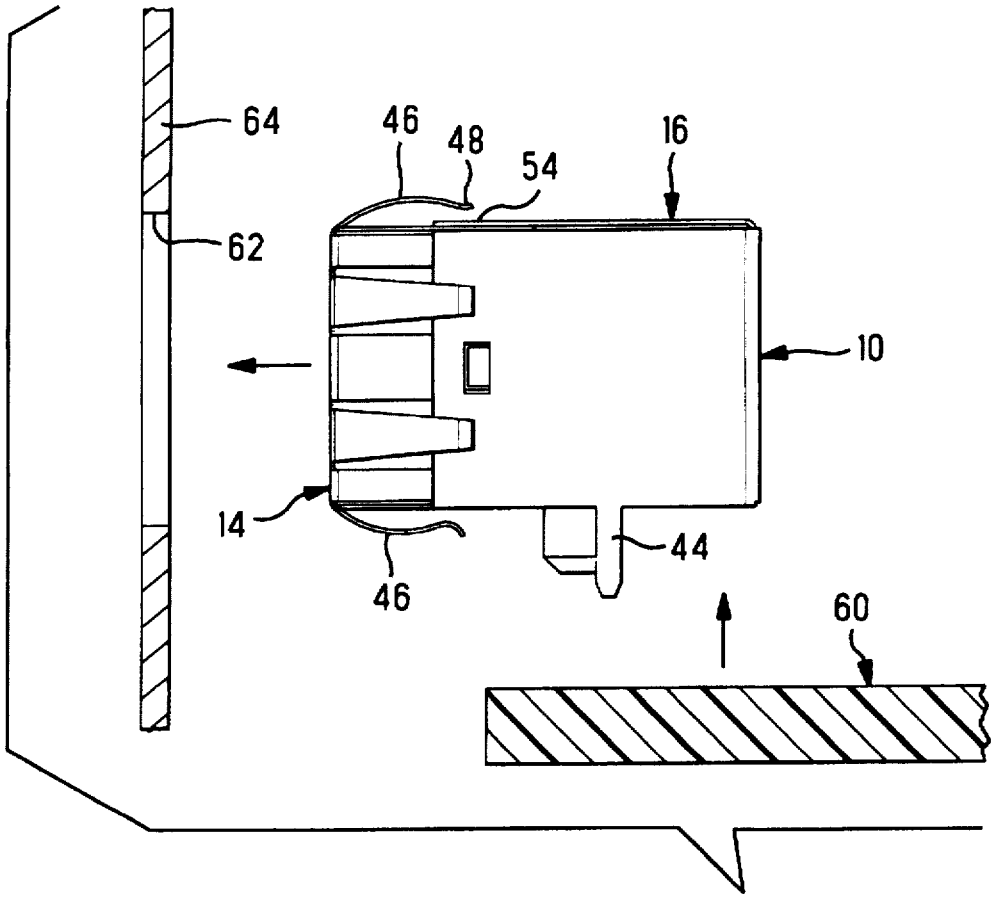
FIGS. 3 and 4 are elevation views illustrating the insertion of the connector of FIGS. 1 and 2 into a panel cutout.
Figure 4:
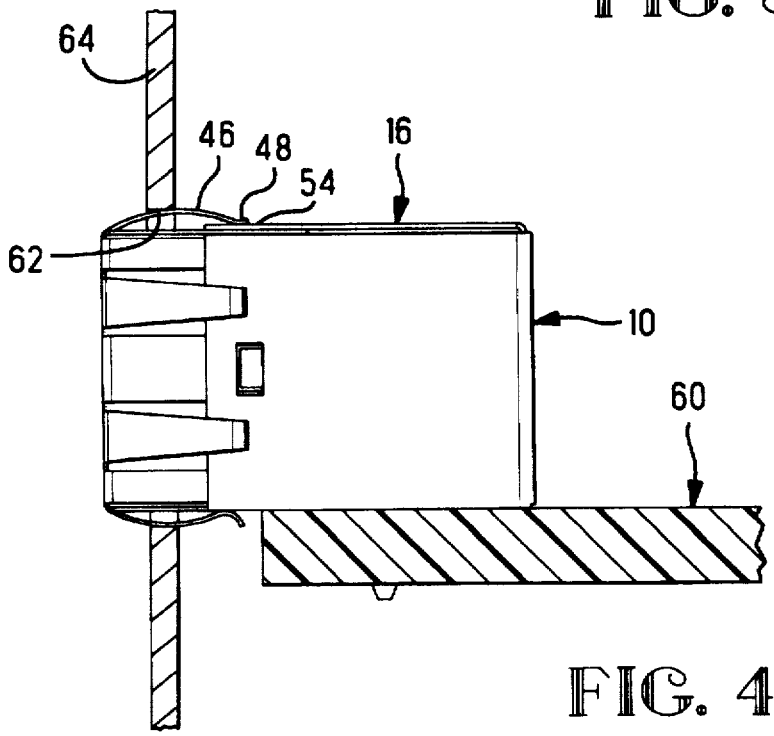

Referring now to FIGS. 3 and 4, connector 10 is being mounted onto a circuit board 60 to extend through a cutout 62 of a panel 64 of conductive material, at an input/output port of an apparatus (not shown) with plug-receiving cavity 24 exposed for receipt of a plug connector (not shown) from outside of the apparatus. In FIG. 4 it is seen that spring fingers 46 have been engaged by the surfaces of panel 64 defining the cutout 62 and have been deflected toward the outer surfaces of the connector. It is seen that free ends 48 of spring fingers 46 have become urged into engagement with forward portions 54 of rear shell member 16, so that both ends of the spring fingers are in electrical engagement with the shield of the connector after being mounted in the panel cutout Optionally, a bottom shell wall member (not shown) may be provided, either integral with rear shell member 34 or clinched thereto, to be engaged by the spring fingers along the bottom of front shell member 14; the bottom wall would be apertured to accommodate ground pins 44, positioning posts of the housing, and contact pins of the signal contacts that would depend from the board-mounting face of the housing. Alternatively, in lieu of a separate rear shell member, a conductive strap (not shown) or collar could be secured about front shell member 14 inserted beneath the spring fingers to cover the cutouts; also, it is possible to provide tabs (not shown) on side edges of the side walls of the front shell that could be folded to cover the cutouts, if desired, such that an integral shell member could be utilized stamped from a metal sheet.

Such conductive engagement at both ends of the spring fingers eliminates the free-standing nature of such structures so that the structures do not act as miniature antennae and no longer serve to generate false signals or interference.

Figure 5:
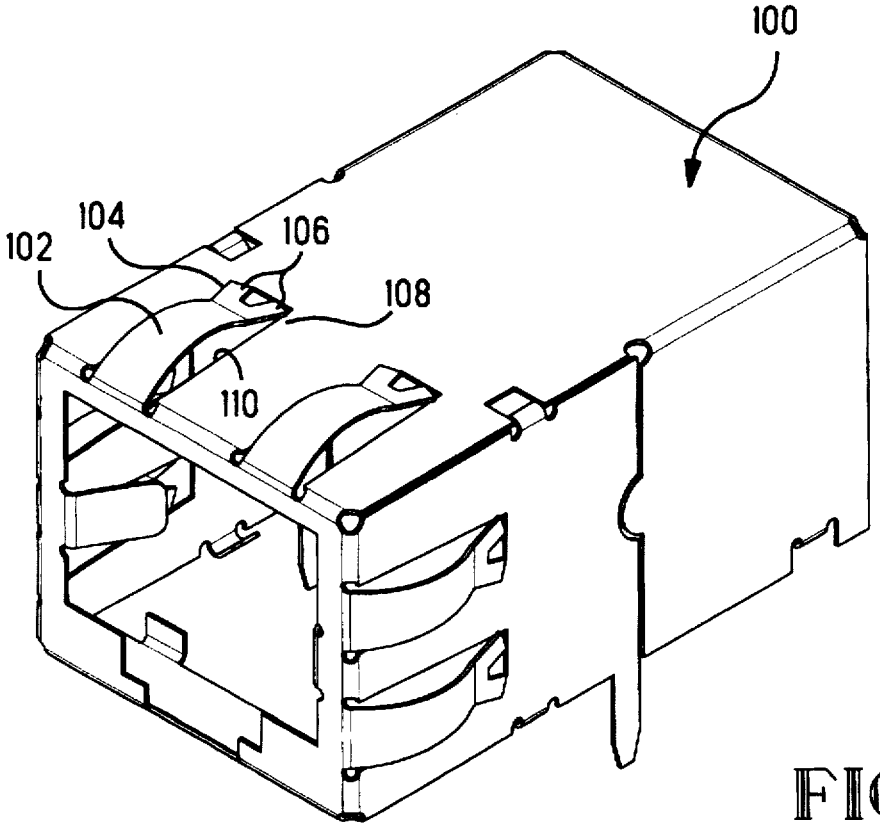
FIG. 5 is an isometric assembled view of a second embodiment of the present invention utilizing a single shell member.

Another embodiment of the present invention is illustrated in FIG. 5, wherein a single shell member 100 is shown for a connector. Spring fingers 102 are seen to extend to free ends 104 and are shown in their deflected state as would occur in panel cutout mounting. Free ends 104 have been formed to spread portions 106 laterally outwardly to be superposed over side portions 108 adjacent residual cutouts 110 from which the spring fingers had been originally stamped. In this embodiment only a single shell member is utilized.

Figure 6:
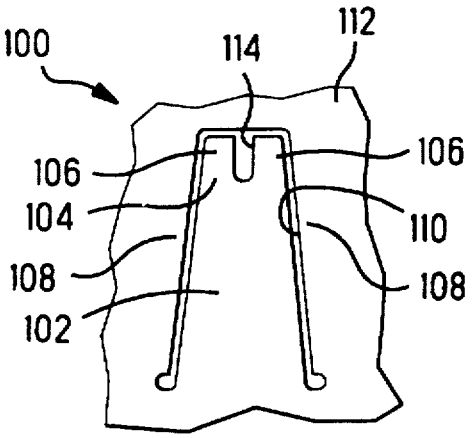
FIGS. 6 and 7, 8 and 9, and 10 and 11 are illustrations of two steps in the forming of three embodiments of spring fingers from sheets of metal.
Figure 7:
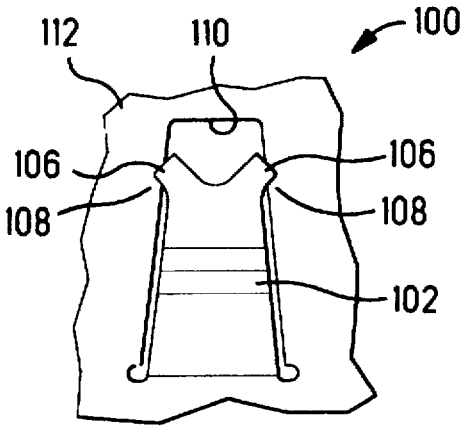

Formation of such spring fingers is depicted in FIGS. 6 and 7. In FIG. 6 spring finger 102 is shown after being stamped from blank 112, and free end 104 preferably includes a slit 114. In FIG. 7, free end 104 has been spanked by tooling (not shown) to spread laterally the portions 106 adjacent slit 114, so that portions 106 now overlie side portions 108 of cutout 110, and free end 104 is also seen to be partially retracted since spring finger 102 has also been formed into an arcuate shape.

Figure 8:
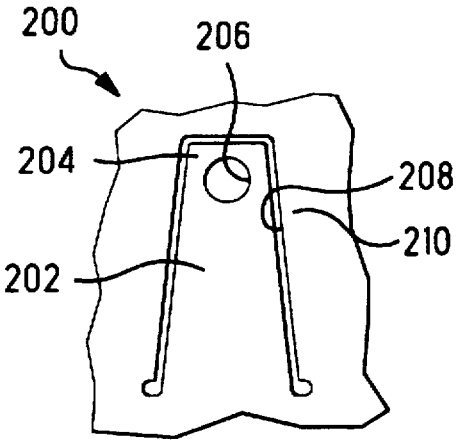
Figure 9:
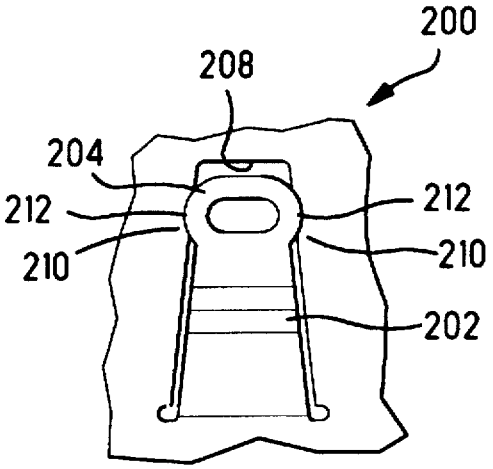

In FIGS. 8 and 9 is seen another embodiment of shield having a spring finger 202 with free end 204 having a hole 206 and stamped from residual cutout 208 with side portions 210 adjacent cutout 208. In FIG. 9 free end 204 has been struck by a die punch of appropriate design to laterally enlarge hole 206 such that portions 212 are urged laterally to overlie side portions 210 adjacent residual cutout 208 to assure engagement by free end 204 upon deflection theretoward.

Figure 10:
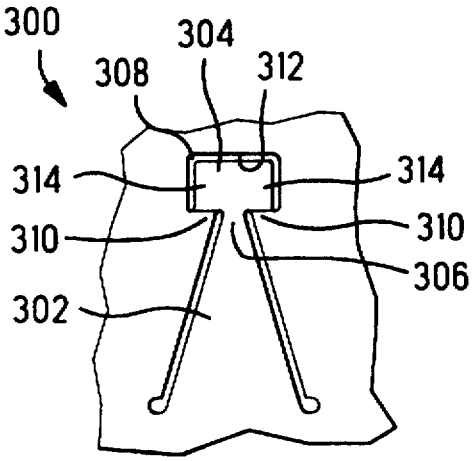
Figure 11:
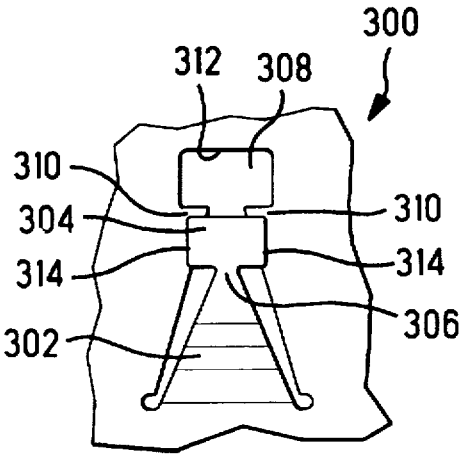

Similarly, in FIGS. 10 and 11 another embodiment of shield 300 is shown having a spring finger 302 with free end 304 that is wider than a narrow neck 306 joining free end 304 to the remainder of the spring finger, when stamped from residual cutout 308 having side portions 310 adjacent where neck 306 was derived. Upon the forming of spring finger 302 into an arcuate shape, free end 304 is seen to retract from trailing end 312 of residual cutout 308, so that lateral tabs 314 of free end 304 now overlie side portions 310 adjacent residual cutout 308 and are engageable therewith upon deflection thereagainst.

Other variations and modifications may be made to the embodiments of the present invention described herein that are within the spirit of the invention and scope of the claims.

What is claimed is:

1. A shield for an electrical connector for being mounted in a cutout of a conductive panel of an apparatus, comprising:

said shield having at least a first shell member adapted to be received into said panel cutout upon mounting of the connector, said first shell member including an array of spring fingers extending rearwardly from joints with said first shell member at edges of a front wall thereof protrude sufficiently outwardly from sides of said first shell member to be engaged by peripheral surfaces of said panel cutout and be deflected toward said sides; and free ends of said spring fingers adapted to engage portions of said shield upon said deflection by said panel cutout surfaces upon connector mounting, thus being electrically engaged with said shield.

2. The shield as set forth in claim 1 wherein said shield includes a second shell member rearwardly from said first shell member and having front portions underlying free ends of said spring fingers upon assembly to said connector in electrical engagement with said first shell member.

3. The shield as set forth in claim 1 wherein said free end of at least one of said spring fingers has been stamped from a metal blank to leave a residual cutout, and said free end has been further formed to define lateral portions overlying side portions adjacent said residual cutout, to be engageable therewith upon deflection of said spring finger.

4. The shield as set forth in claim 3 wherein said free end includes a slot extending thereinto to define a pair of portions adjacent said slot, and said portions have been deformed laterally outwardly to overlie said side portions adjacent said residual cutout.

5. The shield as set forth in claim 3 wherein said free end includes a hole therethrough, and said free end has been deformed to urge portions beside each side of said hole laterally outwardly to overlie said side portions adjacent said residual cutout.

6. The shield as set forth in claim 3 wherein said free end extends from a narrow neck, with said side portions of said residual cutout disposed adjacent said narrow neck, and said free end thus includes lateral portions extending laterally beyond sides of said narrow neck, and upon forming said spring finger into an arcuate shape, said free end retracts to move said lateral portions overtop said side portions adjacent said residual cutout.

* * * * *